US008559847B2

(12) United States Patent
Murakawa

(10) Patent No.: US 8,559,847 B2
(45) Date of Patent: Oct. 15, 2013

(54) IMAGING UNIT AND IMAGE FORMING APPARATUS INCLUDING CONNECTING DEVELOPMENT DEVICE AND DRUM CARTRIDGE

(75) Inventor: Junji Murakawa, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 226 days.

(21) Appl. No.: 13/062,913

(22) PCT Filed: Sep. 4, 2009

(86) PCT No.: PCT/JP2009/065495

§ 371 (c)(1),
(2), (4) Date: Mar. 8, 2011

(87) PCT Pub. No.: WO2010/032633

PCT Pub. Date: Mar. 25, 2010

(65) Prior Publication Data

US 2011/0200358 A1 Aug. 18, 2011

(30) Foreign Application Priority Data

Sep. 18, 2008 (JP) ..... 2008-239164

(51) Int. Cl.
*G03G 21/18* (2006.01)

(52) U.S. Cl.
USPC ..... 399/113

(58) Field of Classification Search
USPC ..... 399/111, 113, 119
See application file for complete search history.

(56) References Cited

U.S. PATENT DOCUMENTS

| | | | | |
|---|---|---|---|---|
| 5,848,330 | A | 12/1998 | Nakaue et al. | |
| 6,546,217 | B2 * | 4/2003 | Okabe et al. | 399/113 |
| 6,708,011 | B2 | 3/2004 | Nomura et al. | |
| 7,302,205 | B2 * | 11/2007 | Shintani et al. | 399/111 |
| 7,340,198 | B2 | 3/2008 | Takigawa | |
| 7,493,061 | B2 | 2/2009 | Hatori et al. | |
| 7,561,826 | B2 | 7/2009 | Takigawa | |
| 7,565,094 | B2 * | 7/2009 | Ishikawa | 399/111 |

(Continued)

FOREIGN PATENT DOCUMENTS

| | | |
|---|---|---|
| JP | 4-93849 | 8/1992 |
| JP | 6-11918 | 1/1994 |

(Continued)

OTHER PUBLICATIONS

International Search Report mailed Oct. 13, 2009 directed towards corresponding international application No. PCT/JP2009/065495; 4 pages.

(Continued)

*Primary Examiner* — Robert Beatty
(74) *Attorney, Agent, or Firm* — Morrison & Foerster LLP

(57) ABSTRACT

In an imaging unit including a drum cartridge having an image carrier composed of a photosensitive drum and a development device having a development roller facing the image carrier, the development device developing an electrostatic latent image formed on the image carrier to form a toner image. The drum cartridge and the development device are provided so as to be allowed to be connected to and separated from each other. The drum cartridge and the development device, when connected to each other, can be made to pivot relative to each other on a shaft of the development roller of the development device.

10 Claims, 5 Drawing Sheets

(56) References Cited

U.S. PATENT DOCUMENTS

| | | | | |
|---|---|---|---|---|
| 7,899,358 | B2 * | 3/2011 | Ishikawa | 399/111 |
| 8,170,444 | B2 * | 5/2012 | Kanno et al. | 399/111 |
| 2004/0042817 | A1 * | 3/2004 | Mori | 399/113 |

FOREIGN PATENT DOCUMENTS

| | | |
|---|---|---|
| JP | 8-30060 | 2/1996 |
| JP | 9-300694 | 11/1997 |
| JP | 10-142945 | 5/1998 |
| JP | 11-109830 | 4/1999 |
| JP | 11-282323 | 10/1999 |
| JP | 2003-15378 | 1/2003 |
| JP | 2003-280490 | 10/2003 |
| JP | 2006-47330 | 2/2006 |
| JP | 2006-58913 | 3/2006 |
| JP | 2006-84698 | 3/2006 |
| JP | 2007-286575 | 11/2007 |

OTHER PUBLICATIONS

JP Notification of Reason for Refusal mailed Oct. 6, 2009 directed towards corresponding application No. JP-2008-239164; 6 pages.
JP Notification of Reason for Refusal mailed Jul. 13, 2010 directed towards corresponding application No. JP-2008-239164; 6 pages.
JP Notification of Reason for Refusal mailed Feb. 15, 2011 directed towards corresponding application No. JP-2008-239164; 7 pages.

* cited by examiner

IMAGING UNIT AND IMAGE FORMING APPARATUS INCLUDING CONNECTING DEVELOPMENT DEVICE AND DRUM CARTRIDGE

REFERENCE TO RELATED APPLICATIONS

This application is a national stage application under 35 USC 371 of International Application No. PCT/JP2009/065495, filed Sep. 4, 2009, which claims the priority of Japanese Application No. 2008-239164, filed Sep. 18, 2008, the contents of which prior applications are incorporated herein by reference.

FIELD OF THE INVENTION

The present invention relates to an imaging unit and an image forming apparatus of electrographic type such as color/monochrome copying machine, printer, and facsimile.

BACKGROUND OF THE INVENTION

An image forming apparatus of electrographic type is composed of an electrification device for uniformly electrifying an image carrier, an exposure device for exposing a surface of the image carrier to light so as to form an electrostatic latent image, a development device for making the electrostatic latent image into a visible image by developer, a transfer device for transferring the visible image onto a recording medium, a cleaning device for removing the developer that remains on the image carrier after the transfer, and a fixation device for fixing the visible image on the recording medium.

The image carrier, the electrification device, the exposure device, the development device, the transfer device, and the cleaning device, other than the fixation device, are referred to as process units. Though the process units are not required to be altogether integrated, it is typical for the image carrier, the electrification device, the development device, and the cleaning device to be integrated.

For the process units, long life, high reliability, high image quality, and low price have been required as well as reduction in size and speed-up of the devices, particularly, with increase of full color machines.

For the development device is dominant two-component development method using two-component developer that is typically composed of toner and carrier. The two-component development method makes it possible to perform development for a long period of time by continual replenishment of the toner, but has a problem in that the carrier deteriorates with lapse of time. In recent years, a trickle method has been employed for reducing deterioration of carrier by replenishment with not only toner but carrier on appropriate occasions and by discharge of extra carrier, so that long life and high reliability have been attained.

The devices other than the development device cannot technically be expected to have long lives because of wear in the image carrier, soiling on the electrification device, wear in cleaning blades of the cleaning device, and the like. The image carrier, the electrification device, and the cleaning device are different from the development device in life span, and therefore it is waste of resources to replace the devices in the lump. In some apparatuses, the image carrier, the electrification device, and the cleaning device are integrated into a drum cartridge, which is separated from the development device.

A clearance between the image carrier and a development roller of the development device, however, is extremely important for formation of uniform image densities. For the development device using two-component development, in particular, a difference in the clearance between the image carrier and the development roller along length (axes) thereof might lead to occurrence of image irregularity caused by rickety of the image carrier and the development roller. Accordingly, it is necessary to ensure a proper clearance between the image carrier and the development roller. In a structure as described above that has the drum cartridge and the development device separated from each other, it is difficult to ensure a clearance between the image carrier and the development roller.

In Patent Document 1 is proposed an imaging unit in which holes provided on both sides in the longitudinal direction of a housing of the drum cartridge and holes provided on both sides in the longitudinal direction of a housing of the development device are registered and engagement pins are fitted into the holes from outside. In Patent Document 1, rollers are provided on both sides in the longitudinal direction of a shaft of a development roller, the rollers are brought into contact with a surface of the image carrier at both end parts in the longitudinal direction by elastic members provided on both sides in the longitudinal direction, of the development roller, and a clearance is thereby established between the image carrier and the development roller.

Such a configuration as disclosed in Patent Document 1 has problems as follows. The drum cartridge and the housing of the development device which are formed by injection molding of resin material, undergo great change in dimensions due to change in temperature and have variations in the dimensions due to mass production. Accordingly, there is a fear that positions of the holes of the housing of the drum cartridge and a position of the image carrier might be deviated in the longitudinal direction and/or that positions of the holes of the housing of the development device and a position of the development roller might be deviated in the longitudinal direction. Besides, rickety may occur in fitting parts between the holes and the engagement pins engaged therewith. Then, in a situation that the drum cartridge and the development device are connected to each other, there is caused a variation in the longitudinal direction in positions of fulcrums on which the development device is pivoted relative to the drum cartridge. Therefore, distortion is produced in the unit and an angle of a development nip part is deviated in the longitudinal direction. Furthermore, the distortion in the unit causes one-side contact of the rollers with the surface of the image carrier and thus makes it impossible to maintain the clearance between the image carrier and the development roller with high accuracy. In addition, as the rollers are in contact with the surface of the image carrier at both the end parts with respect to the longitudinal direction, toner dispersed from the development device may adhere to the image carrier, soil the rollers, and thereby cause pitch irregularity.

In Patent Document 2, engagement between the development device and the drum cartridge is attained with use of shafts and grooves at four sites front and rear with respect to a longitudinal direction. The shafts and grooves at the four sites, however, do not necessarily coincide with each other and engagement of the shafts and grooves may cause distortion in the unit. It is therefore difficult to maintain a clearance between the development roller and the image carrier with high accuracy.

Patent Document 1: JP H10-142945 A
Patent Document 2: JP 2003-280490 A

SUMMARY OF INVENTION

The invention has been made in consideration of the problems of the prior arts and an object of the invention is to provide an imaging unit and an image forming apparatus in which a development device and a drum cartridge can be connected to each other simply, reliably and highly accurately and can be separated from each other with simple operation.

In order to resolve the problems, first solution is an imaging unit including:

a drum cartridge having an image carrier composed of a photosensitive drum, and a development device having a development roller facing the image carrier, the development device developing an electrostatic latent image formed on the image carrier to form a toner image, the imaging unit characterized in that the drum cartridge and the development device are provided so as to be allowed to be connected to and separated from each other and the drum cartridge and the development device, when connected to each other, can be made to pivot relative to each other on a shaft of the development roller of the development device.

Second solution is the unit in the first solution in which a roller or a D-cut shaft is provided on the shaft of the development roller of the development device, and wherein a butting member with which the roller or the D-cut shaft of the development roller is to butt and a fixation release member which is capable of pressing the roller or the D-cut shaft of the development roller against the butting member and which is capable of releasing the pressure against the butting member is provided on the drum cartridge.

Third solution is the unit in the previous solution in which the drum cartridge and the development device in a situation connected to each other can be attached to an image forming apparatus body in an axial direction along rails provided on the image forming apparatus body and can be drawn out of the image forming apparatus body.

Fourth solution is the unit in the previous solution in which further including a plurality of positioning members for positioning of the drum cartridge with respect to the image forming apparatus body when the drum cartridge and the development device in a situation connected to each other are attached to the image forming apparatus body, and a turn prevention member for preventing the development device from turning relative to the drum cartridge.

Fifth solution is the unit in the previous solution in which the development device is prevented by the turn prevention member from turning after the positioning of the drum cartridge is achieved by the positioning members.

Sixth solution is an image forming apparatus including the imaging unit, rails for attaching and drawing of the imaging unit, and receiving members for positioning of the imaging unit.

According to the first solution of the invention, as the drum cartridge and the development device are capable of pivoting relative to each other on the shaft of the development roller of the development device, it is possible to suppress distortion of the unit and maintain a clearance between the image carrier and the development roller with high accuracy.

According to the second solution of the invention, as the pressure members are capable of pressing the rollers of the development roller against the butting members of the drum cartridge and are capable of releasing the pressure against the butting members, it is possible to connect the development device and the drum cartridge to each other simply, reliably and highly accurately and separate them from each other by simple operation.

According to the third solution of the invention, attaching the imaging unit to the image forming apparatus body and drawing out the imaging unit from the image forming apparatus body are facilitated.

According to the fourth solution of the invention, the positioning of the drum cartridge with respect to the image forming apparatus body is initially achieved and the positioning of the development device with respect to the drum cartridge is subsequently achieved by the turn prevention member.

According to the fifth solution of the invention, as the development device is prevented from turning after the positioning of the drum cartridge, the positioning can be achieved with high accuracy.

According to the sixth solution of the invention, the image forming apparatus can be provided that is capable of maintaining the clearance between the image carrier of the drum cartridge and the development roller of the development device with high accuracy and that is capable of achieving the positioning of the drum cartridge and the development device with high accuracy.

EXPLANATION OF THE NUMERALS

Figure 1:
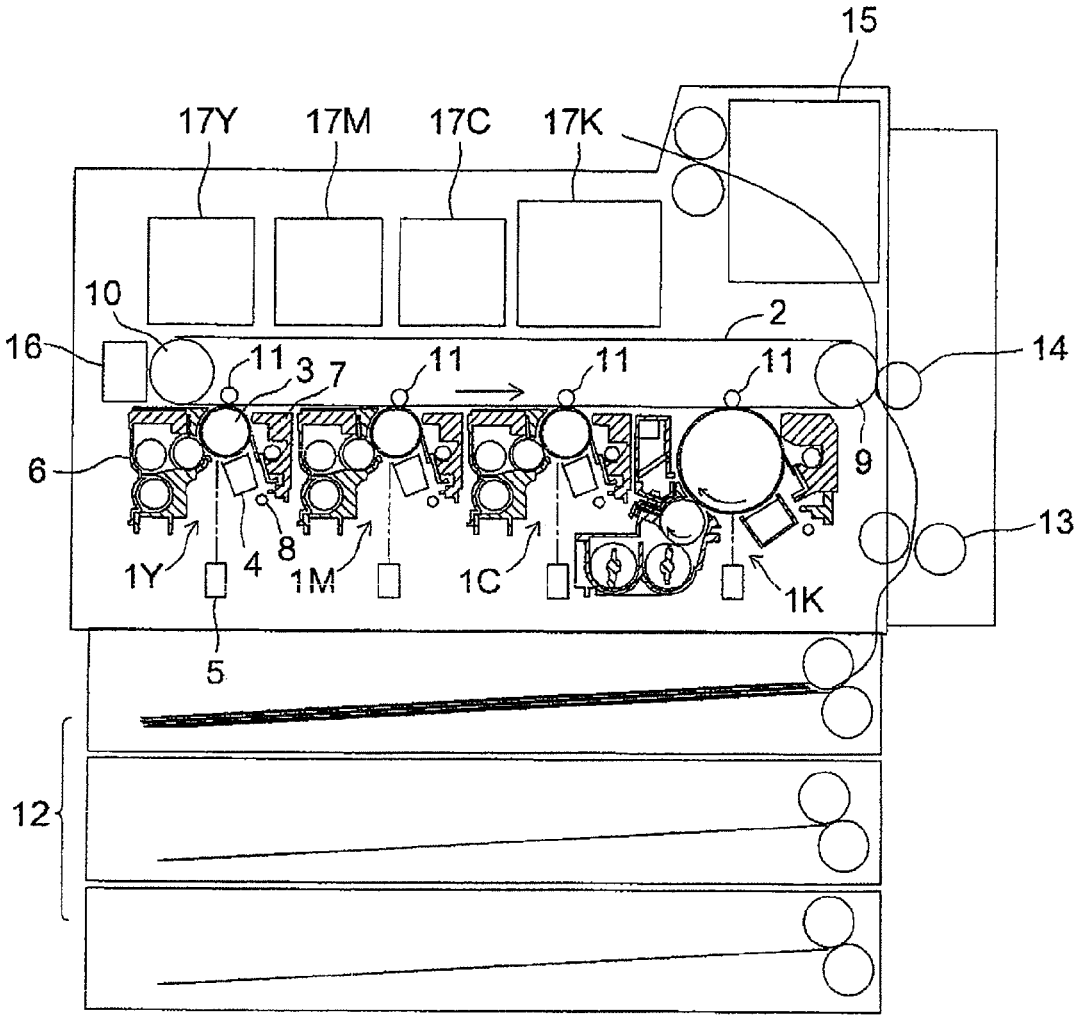
FIG. 1 is a schematic configuration of an image forming apparatus in accordance with the invention.

3 Development device
20 Imaging unit
21 Drum cartridge
25 Butting member
26 Fixation release member
45 Pin (positioning member)
46 Pin (positioning member)
47 Pin (positioning member)
48 Pin (positioning member)
51 Development tank
52 Development roller
57 Roller
58 D-cut shaft
61 Pin (turn prevention member)
63 Holes (turn prevention member)
70 Image forming apparatus body
71 Hole (receiving member)
72 Hole (receiving member)
73 Hole (receiving member)
74 Rails

DETAILED DESCRIPTION OF THE INVENTION

Hereinbelow, an embodiment of the invention will be described in accordance with the accompanying drawings.

FIG. 1 is a schematic configuration of an image forming apparatus of the invention. In the image forming apparatus, image forming units 1Y, 1M, 1C, and 1K for forming toner images in yellow (Y), magenta (M), cyan (C), and black (K), respectively, are provided along an intermediate transfer belt 2.

The image forming units 1Y, 1M, 1C, and 1K are each composed of an image carrier 3 formed of a photosensitive drum provided in proximity to the intermediate transfer belt 2, an electrification device 4 for uniformly electrifying a surface of the image carrier 3 so as to produce an electric potential, an exposure device 5 for exposing the surface of the image carrier 3 to light on basis of an image signal so as to form an electrostatic latent image, a development device 6 for making toner adhere onto the electrostatic latent image on the image carrier 3 so as to develop the image and form a toner image in the respective color, a cleaning device 7 for removing the toner that remains on the image carrier 3, and an electricity removal device 8.

The intermediate transfer belt 2 is stretched between a driving roller 9 and a driven roller 10 and is capable of running in a direction of an arrow. Inside the intermediate transfer belt 2 are provided primary transfer rollers 11 that face the image carriers 3 of the image forming units 1Y, 1M, 1C, and 1K via the intermediate transfer belt 2 and that form a color toner image by transfer of the toner images on the image carriers 3 onto the intermediate transfer belt 2. A secondary transfer roller 14 that transfers the color toner image on the intermediate transfer belt 2 onto a paper sheet fed from a paper feeding unit 12 through timing rollers 14 is provided so as to face the driving roller 9 for the intermediate transfer belt 2 via the intermediate transfer belt 2. On downstream side of the secondary transfer roller 14 in a direction of conveyance of paper sheets is provided a fixation device 15 for fixing the color toner image transferred by the secondary transfer roller 14. A belt cleaning device 16 for removing the toner that remains on the intermediate transfer belt 2 is provided so as to face the driven roller 10 for the intermediate transfer belt 2 through the intermediate transfer belt 2.

Above the intermediate transfer belt 2 are provided developer cartridges 17Y, 17M, 17C, and 17K for the colors Y, M, C, and K for supplying developer through supply channels not shown to the development devices 6 of the image forming units 1Y, 1M, 1C, and 1K for the respective colors. As the developer, two-component developer composed of toner and carrier with a specified mixing ratio is contained therein.

The above configuration of the image forming apparatus is an example of a tandem-type color image forming apparatus and can be applied to color image forming apparatuses of other types, monochromatic image forming apparatuses having only one imaging unit, and the like.

Figure 2:
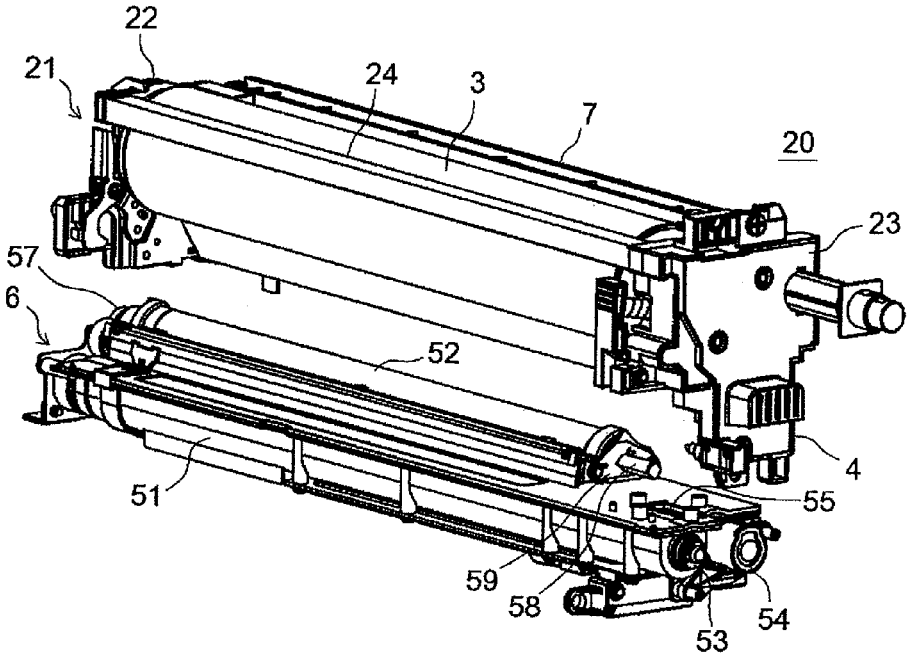
FIG. 2 is a perspective view of an imaging unit having a drum cartridge and a development device separated from each other, as seen from front side thereof.
Figure 3:
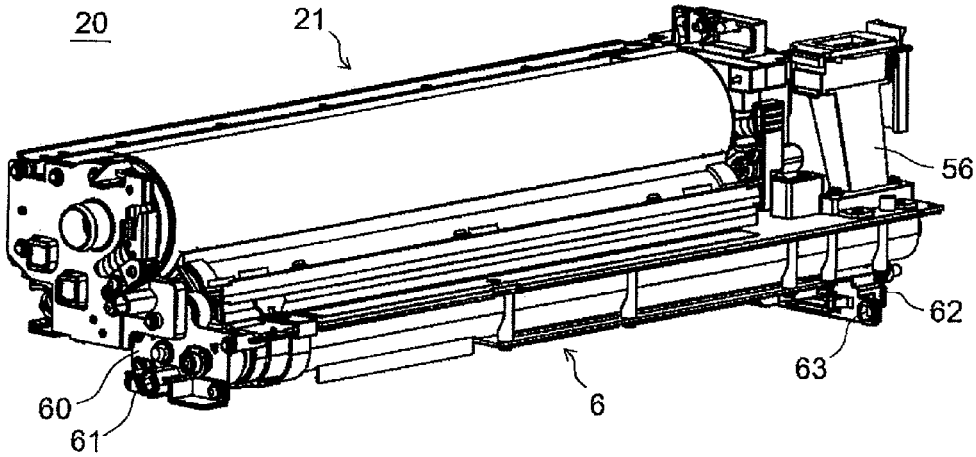
FIG. 3 is a perspective view of the imaging unit having the drum cartridge and the development device connected to each other, as seen from back side thereof.

FIGS. 2 and 3 show an imaging unit 20 in accordance with the invention, specifically, the imaging unit 20 for black that employs a trickle method and that is separated and connected, respectively. It is needless to say that the invention can be applied not only to the imaging unit 20 for black of the trickle type but also to the unit that is not of the trickle type and other imaging units for yellow, magenta, and cyan. The invention can be applied to one-component development methods.

The imaging unit 20 is composed of a drum cartridge 21 and the development device 6 that are configured as separate bodies.

The drum cartridge 21 has a back side frame 22 and a front side frame 23 that are made of resin, and a connection frame 24 that connects the frames 22, 23 and that is made of metal. Between the back side frame 22 and the front side frame 23, the image carrier 3 composed of the photosensitive drum is rotatably supported, and the electrification device 4, the cleaning device 7 and an electricity removal device not shown are fixed so as to face the image carrier 3. The electricity removal device may be provided on side of the image forming apparatus.

Figure 4:
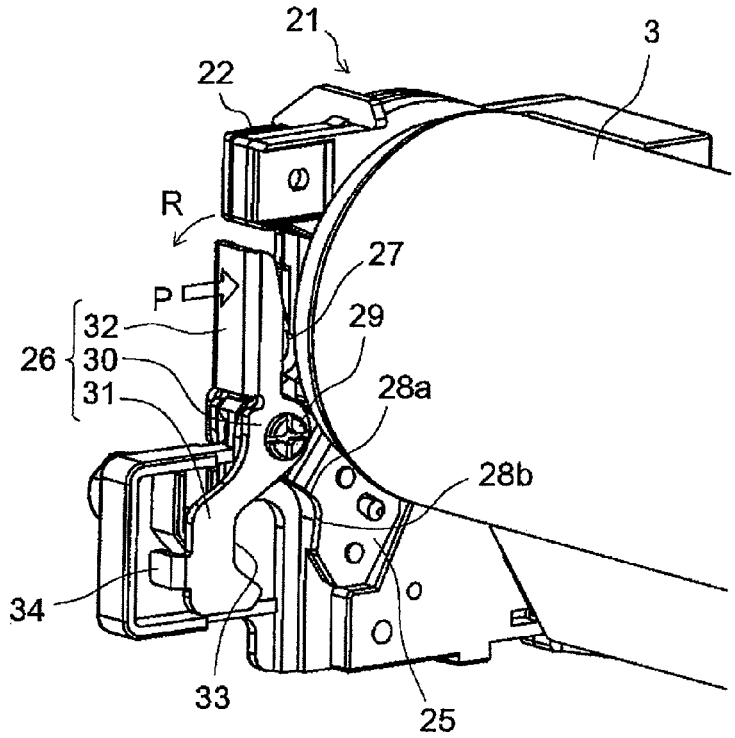
FIG. 4 is an enlarged perspective view of a back side frame of the drum cartridge.

As shown in FIG. 4, on an inside surface of the back side frame 22 of the drum cartridge 21 are mounted a butting member 25, a fixation release member 26, and a compression spring 27. The butting member 25 has two collision parts 28*a*, 28*b*, with which a roller 57 of a development roller 52 that will be described later is to butt, on a cut-out edge thereof. Though the butting member 25 may be of fixed type, the butting member 25 is mounted by a screw 29 so that a position of the butting member 25 can be adjusted, for fear that accuracy cannot be ensured. The fixation release member 26 is made of metal and is composed of a fulcrum part 30 mounted by the same screw 29 as for the butting member 25, a fixation part 31 extending toward one side from the fulcrum part 30, and a release part 32 extending toward the other side therefrom. On cut-out edges of the fixation part 31 are formed a pressure part 33 that faces the two collision parts 28*a*, 28*b* described above and that is to press the roller 57 of the development roller 52 that will be described later, and a stopper 34 that is to engage with and to stop on a portion of the back side frame 22. The release part 32 is formed so as to be allowed to be pressed by a finger in a direction of an arrow P and is pressed and biased by a compression coil spring 27 in a direction opposite to the arrow P so that the fixation release member 26 pivots on the screw 29 in a direction of an arrow R and so that the stopper 34 engages with and stops on the portion of the back side frame 22.

Figure 5:
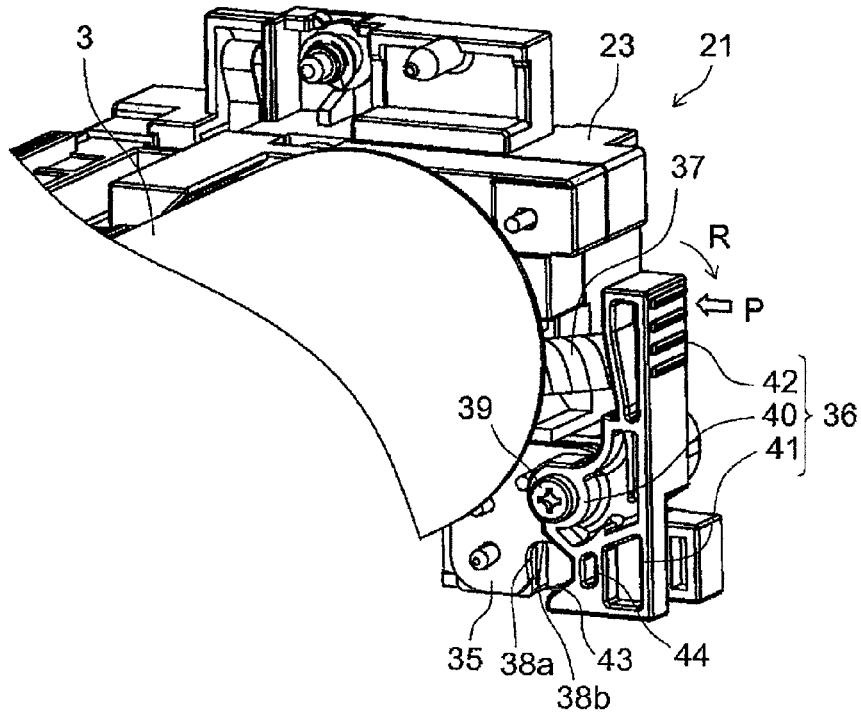
FIG. 5 is an enlarged perspective view of a front-side frame of the drum cartridge.

As shown in FIG. 5, on an inside surface of the front side frame 23 of the drum cartridge 21 are mounted a butting member 35, a fixation release member 36, and a compression spring 37. In a manner similar to the butting member 25 of the back side frame 22 in FIG. 4, the butting member 35 has two collision parts 38*a*, 38*b*, with which an outer circumferential arcuate part of a D-cut shaft 58 of the development roller 52 that will be described later is to butt, on a cut-out edge thereof. Though the butting member 35 may be of fixed type, the butting member 35 is mounted by a screw 39 so that a position of the butting member 35 can be adjusted, for fear that accuracy cannot be ensured. The fixation release member 36 is made of synthetic resin, in contrast to the fixation release member 26 of the back side frame 22 in FIG. 4. The fixation release member 36 is basically similar to the fixation release member of the back side frame 22 in FIG. 4 except that the member 36 is a little different therefrom in shape, and is composed of a fulcrum part 40 mounted by the same screw 39 as for the butting member 35, a fixation part 41 extending toward one side from the fulcrum part 40, and a release part 42 extending toward the other side therefrom. On cut-out edges of the fixation part 41 are formed a pressure part 43 that faces the two collision parts 38*a*, 38*b* described above and that is to press an outer circumferential flat part of the D-cut shaft 58 of the development roller 52 that will be described later, and a stopper 44 that is to engage with and to stop on a portion of the front side frame 23. The release part 42 is formed so as to be allowed to be pressed by a finger in a direction of an arrow P and is pressed and biased by a compression coil spring 37 in a direction opposite to the arrow P so that the fixation release member 36 pivots on the screw 39 in a direction of an arrow R and so that the stopper 44 engages with and stops on the portion of the front side frame 23.

Figure 6:
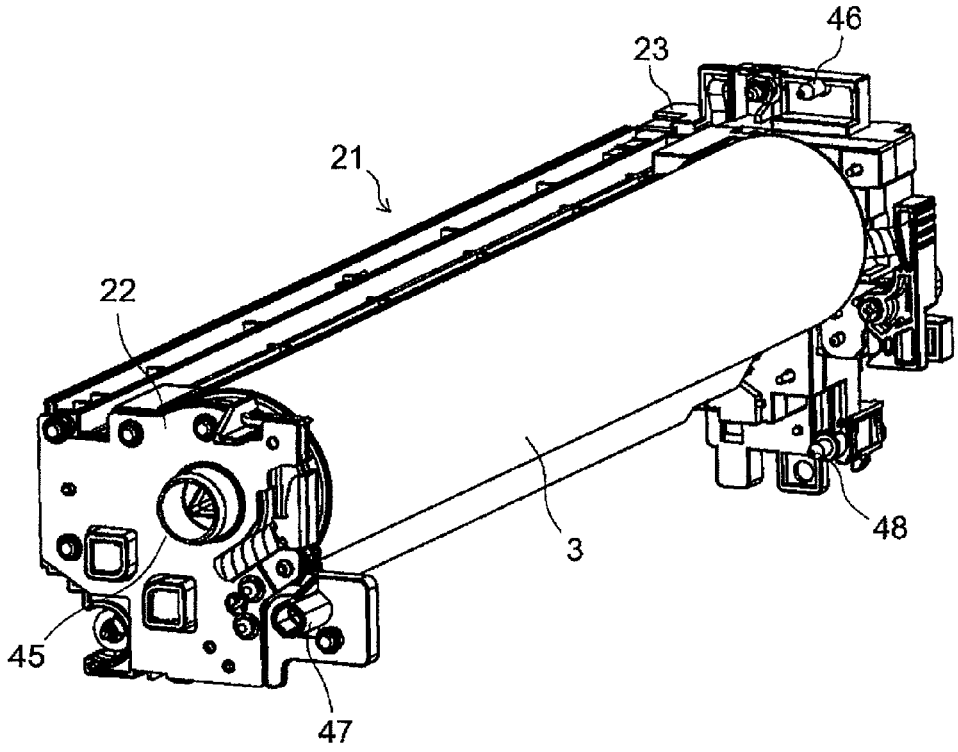
FIG. 6 is a perspective view of the drum cartridge as seen from the back side.
Figure 9:
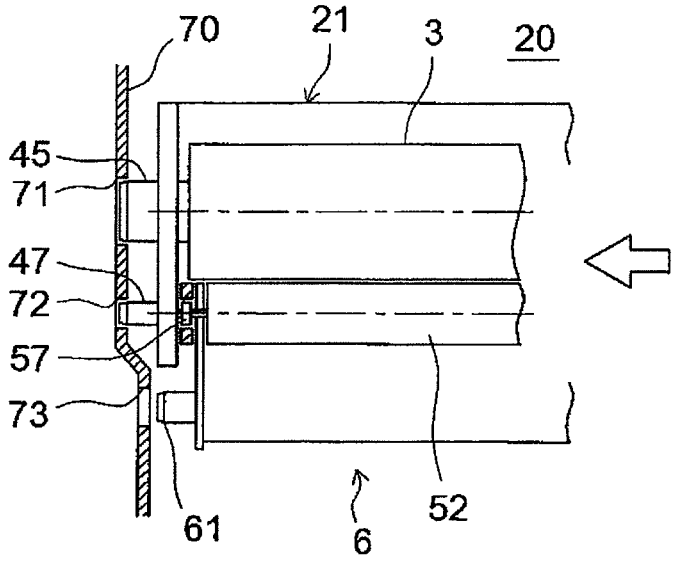
FIG. 9 is a plan view showing the attachment and detachment of the imaging unit to and from the image forming apparatus on the back side.

On an outside surface of the back side frame 22 and the inside surface of the front side frame 23 of the drum cartridge 21, as shown in FIG. 6, pins 45 and 46 for positioning in a longitudinal direction relative to an image forming apparatus body 70 are provided, respectively, so as to protrude in a direction of attachment of the drum cartridge 21. The pin 45 has the same axis as the image carrier 3 has, while the pin 46 is eccentric relative to the axis of the image carrier 3. On the outside surface of the back side frame 22 of the drum cartridge 21, a pin 47 for positioning of the drum cartridge 21 in a rotational direction is further provided so as to protrude in the direction of attachment of the drum cartridge 21. Though the positioning is basically effected by the pins 45, 46 and 47 at the three points, a pin 48 is further provided on the inside surface of the front side frame 23 on condition that rigidity of the drum cartridge 21 cannot be ensured by the three pins. As shown in FIG. 9, holes 71, 72 (only the back side is shown) or slots for receiving the pins 45 through 48 are formed on the image forming apparatus body 70. There may be holes on the side of the drum cartridge and pins on the side of the image forming apparatus body 70.

In the development device 6, as shown in FIG. 2, the development roller 52 is rotatably provided in an upper part opening of a development tank 51 made of resin so as to face the image carrier 3, and two developer conveyor screws 53, 54 are provided in lower part of the development tank 51. On the front side of the development tank 51, a developer supply port 55 is formed so as to face upward and a developer supply device 56 shown in FIG. 3 is mounted on the supply port 55.

On an end part of a back side shaft of the development roller 52 of the development device 6, a roller 57 is mounted so as to be rotatable with respect to the shaft. An end part of a front-side shaft of the development roller 52 forms the D-cut shaft 58 having a D-shape section. To the development tank 51 is fixed a pole determination member 59 that engages with the D-cut shaft 58 and that determines magnetic configuration in the development roller 52. A roller 57 may be mounted on the D-cut shaft 58, in such a manner as in the back side frame 22, and may be held by the butting member 35 and the fixation release member 36 of the drum cartridge 21.

As shown in FIG. 3, on an outside surface of a frame 60 at a back side end of the development device 6 is fixed a pin 61 for preventing the development device 6 from turning relative to the drum cartridge 21. Though positioning of the development device 6 is basically effected on basis of three sites, i.e., the roller 57, the D-cut shaft 58, and the pin 61, a hole 63 may be provided on a frame 62 at a front end on condition that rigidity of the development device 6 cannot be ensured and/or on condition that the development device 6 with a heavy weight is expected to sag down from the drum cartridge 21. On the image forming apparatus body 70 are formed a hole 73 (only the back side is shown) or a slot and a pin for receiving the pin 61 and the hole 63, respectively. There may be a hole on the side of the development device 6 and a pin on the side of the image forming apparatus body 70.

There will be described operations for attaching and detaching the imaging unit 20 having the above configuration to and from the image forming apparatus body 70.

Figure 7:
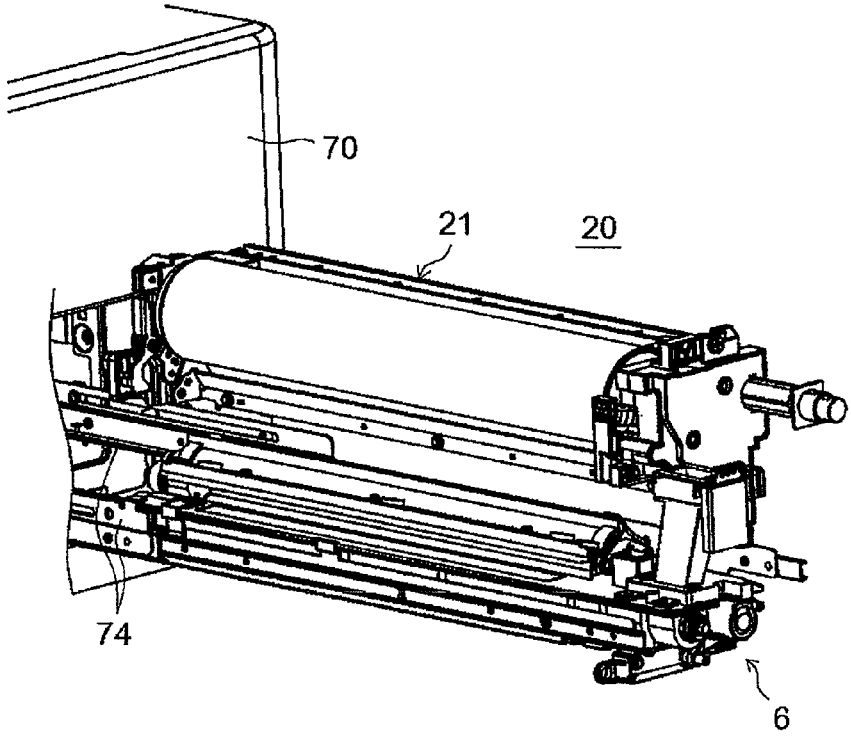
FIG. 7 is a perspective view showing attachment and detachment of the imaging unit to and from the image forming apparatus, as seen from the front side.

For the attachment of the imaging unit 20 to the image forming apparatus body 70, as shown in FIG. 7, the development device 6 is initially loaded on rails 74 drawn to outside from the image forming apparatus body 70.

Subsequently, the drum cartridge 21 is loaded on the development device 6 with the release parts 32, 42 of the fixation release members 26, 36 on both ends of the drum cartridge 21 pressed by fingers. On this occasion, the roller 57 of the development roller 42 butts with the collision parts 28*a*, 28*b* of the butting member 25 of the drum cartridge 21 on the back side, while the D-cut shaft 58 of the development roller 52 butts with the collision parts 38*a*, 38*b* of the butting member 35 of the drum cartridge 21 on the front side. Once the fingers are released from the release parts 32, 42 of the fixation release members 26, 36, the pressure part 33 of the fixation part 31 of the fixation release member 26 presses the roller 57 of the development roller 52 on the back side and the pressure part 43 of the fixation part 41 of the fixation release member 36 presses the D-cut shaft 58 of the development roller 52 on the front side.

Figure 8:
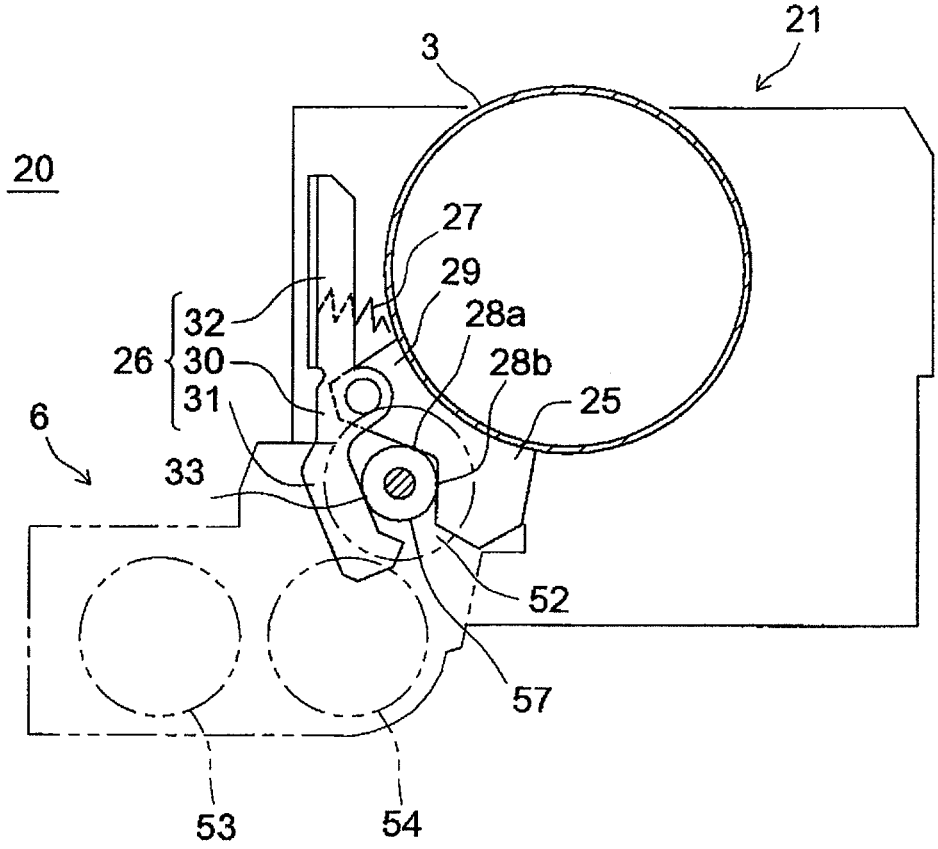
FIG. 8 is a diagram showing a state in which the development device and the drum cartridge have been assembled.

Thus the drum cartridge 21 and the development device 6 are connected to each other so as to be integrated. In this state, as shown in FIG. 8, the development device 6 can be made to pivot on the shaft of the development roller 52 relative to the drum cartridge 21.

Once the imaging unit 20 having the development device 6 and the drum cartridge 21 in a situation connected to each other is pushed into the image forming apparatus body 70 along the rails 74, the pins 45, 46, 47 and 48 on the drum cartridge 21 initially engage with the holes 71, 72 (only the back side is shown) provided on the image forming apparatus body 70 so that the positioning thereof is achieved. Subsequently, the pin 61 and the hole 63 on the development device 6 engage with the hole 73 and the pin (not shown) provided on the image forming apparatus body 70 so that the positioning thereof is achieved and so that the development device 6 is prevented from turning relative to the drum cartridge 21. In this manner, the positioning of the drum cartridge 21 with respect to the image forming apparatus body 70 is initially attained and the positioning of the development device 6 with respect to the image forming apparatus body 70 is subsequently attained. The earlier positioning of the drum cartridge 21 having a rigidity lower than that of the development device 6 with respect to the image forming apparatus body 70 prevents the drum cartridge 21 from twisting and makes it possible to maintain a clearance between the development roller 52 of the development device 6 and the image carrier 3 of the drum cartridge 21 with high accuracy.

For the detachment of the imaging unit 20 from the image forming apparatus body 70, the reverse operations to the attachment are performed. That is, the imaging unit 20 is initially drawn out along the rails 74. Then the positioning of the development device 6 with respect to the image forming apparatus body 70 is initially released so that the development device 6 is allowed to pivot relative to the drum cartridge 21. Subsequently, the positioning of the drum cartridge 21 with respect to the image forming apparatus body 70 is released. Once the imaging unit 20 is drawn to the outside of the image forming apparatus body 70, the release parts 32, 42 of the fixation release members 26, 36 on both the ends of the drum cartridge 21 are pushed by fingers so as to evacuate the pressure part 33, 43 of the fixation part 31, 41 from the roller 57 and the D-cut shaft 58 of the development roller 6, and the drum cartridge 21 is thereafter detached from the development device 6. Finally, the development device 6 is removed from the rails.

Thus, the development device 6 and the drum cartridge 21 can be connected and separated outside the image forming apparatus body, resulting in excellent in operability.

The drum cartridge 21 and the development device 6 in a situation connected to each other may be attached to and detached from the image forming apparatus body 70 along rails fixed to the image forming apparatus body 70 without the provision of the rails 74 for guidance to the outside of the image forming apparatus body 70.

The invention claimed is:

1. An imaging unit comprising:

a drum cartridge having an image carrier composed of a photosensitive drum, a butting member and a fixation release member that rotates about a fulcrum, and a development device having a development roller facing the image carrier, the development device developing an electrostatic latent image formed on the image carrier to form a toner image, wherein the drum cartridge and the development device are provided so as to be allowed to be connected to and separated from each other and the drum cartridge and the development device, when connected to each other, can be made to pivot relative to each other on a shaft of the development roller that is engaged between the butting and fixation release members.

2. The imaging unit as claimed in claim 1, wherein a roller or a D-cut shaft is provided on the shaft of the development roller of the development device to butt with the butting member and the fixation release member, which is capable of pressing the roller or the D-cut shaft of the development roller against the butting member and which is capable of releasing the pressure against the butting member.

3. The imaging unit as claimed in claim 1, wherein the drum cartridge and the development device in a situation connected to each other can be attached to an image forming apparatus body in an axial direction along rails provided on the image forming apparatus body and can be drawn out of the image forming apparatus body.

4. The imaging unit as claimed in claim 1, further comprising a plurality of positioning members for positioning of the drum cartridge with respect to the image forming apparatus body when the drum cartridge and the development device in a situation connected to each other are attached to the image forming apparatus body, and a turn prevention member for preventing the development device from turning relative to the drum cartridge.

5. The imaging unit as claimed in claim 4, wherein the development device is prevented by the turn prevention member from turning after the positioning of the drum cartridge is achieved by the positioning members.

6. An image forming apparatus comprising:

the imaging unit as claimed in claim 1, rails for attaching and drawing of the imaging unit, and receiving members for positioning of the imaging unit.

7. The image forming apparatus as claimed in claim 6, wherein a roller or a D-cut shaft is provided on the shaft of the development roller of the development device to butt with the butting member and the fixation release member, which is capable of pressing the roller or the D-cut shaft of the development roller against the butting member and which is capable of releasing the pressure against the butting member.

8. The image forming apparatus as claimed in claim 6, wherein the drum cartridge and the development device in a situation connected to each other can be attached to an image forming apparatus body in an axial direction along rails provided on the image forming apparatus body and can be drawn out of the image forming apparatus body.

9. The image forming apparatus as claimed in claim 6, further comprising a plurality of positioning members for positioning of the drum cartridge with respect to the image forming apparatus body when the drum cartridge and the development device in a situation connected to each other are attached to the image forming apparatus body, and a turn prevention member for preventing the development device from turning relative to the drum cartridge.

10. The image forming apparatus as claimed in claim 9, wherein the development device is prevented by the turn prevention member from turning after the positioning of the drum cartridge is achieved by the positioning members.

* * * * *